United States Patent [19]

Macey

[11] Patent Number: 4,522,383

[45] Date of Patent: Jun. 11, 1985

[54] RECIPROCATING STITCHER ASSEMBLY

[75] Inventor: Keith S. Macey, Rocky River, Ohio

[73] Assignee: K. S. Macey Machine Company, Inc., Cleveland, Ohio

[21] Appl. No.: 427,671

[22] Filed: Sep. 29, 1982

Related U.S. Application Data

[63] Continuation-in-part of Ser. No. 381,529, May 4, 1982, Pat. No. 4,479,642, which is a continuation-in-part of Ser. No. 364,225, Apr. 1, 1982, abandoned.

[51] Int. Cl.[3] ..... B42B 1/02

[52] U.S. Cl. ..... 270/53; 227/101

[58] Field of Search ..... 270/53, 54, 58; 227/99–102, 104, 105, 155

[56] References Cited

U.S. PATENT DOCUMENTS

| | | | |
|---|---|---|---|
| 2,827,632 | 3/1958 | Faeber | 227/101 |
| 2,998,116 | 8/1961 | Muller | 270/53 X |
| 3,539,180 | 10/1970 | Zugel | 270/53 X |
| 3,554,531 | 6/1971 | Heigl et al. | 270/53 |
| 3,613,217 | 10/1971 | Perkins | 29/432.2 |
| 3,627,305 | 12/1971 | Heigl et al. | 270/68 |
| 3,786,979 | 1/1974 | Muller | 227/44 |
| 4,236,706 | 12/1980 | Schlough | 270/53 |

*Primary Examiner*—E. H. Eickholt

*Attorney, Agent, or Firm*—Fay & Sharpe

[57] ABSTRACT

A binding apparatus includes a plurality of feed stations (10, 12, 14) which stack sheets on an inclined conveying surface (16). A conveyor (20) continuously conveys the stacks along a workpath (w) to a stitcher assembly (B). The stitcher assembly includes a frame assembly (100) having a stitcher head mounting bar (130) and a clincher mounting bar (136) on which stitcher heads and clinchers are mounted in cooperative relationship. A power take-off assembly (54) rotates a stitcher assembly transverse drive shaft (250) in coordination with advancement of the conveyor. The stitcher assembly transverse drive shaft rotates lever arms (260, 262) which are connected by connecting links (264, 266) with a stationary structure such that the frame assembly is cyclically reciprocated longitudinally along the workpath. A stitcher head actuating assembly (270) and a clincher actuating assembly (290) are driven by the stitcher assembly transverse drive shaft to cause the mounted stitcher heads and clinchers to be actuated at the same point in each reciprocation cycle. A register or dog member (160) which is connected with the frame assembly for reciprocation therewith engages a trailing edge of each stack and positions it in a selected registration with the stitcher during the stitch insertion. In this manner, a stitch is inserted in the same location in each conveyed stack.

41 Claims, 6 Drawing Figures

RECIPROCATING STITCHER ASSEMBLY

BACKGROUND OF THE INVENTION

This application is a continuation-in-part of application Ser. No. 381,529 filed May 4, 1982, now U.S. Pat. No. 4,479,642, which in turn is a continuation-in-part of application Ser. No. 364,225, filed Apr. 1, 1982, now abandoned, all entitled Reciprocating Stitcher Assembly.

This invention relates to the art of inserting fasteners into moving workpieces. The invention finds particular application in conjunction with automated binding machinery for stitching a plurality of printed sheets or pages in a desired stacked relationship with each other. Although the stitcher of the present invention is described in combination with automated binding machinery, it is to be appreciated that it has other applications including, for example, inserting stitches or other fasteners into workpieces moving along automated production equipment, pressure and heat bonding of moving workpieces, and the like.

Of many different prior binding apparatus or machines heretofore made available, one apparatus has found particularly significant commercial success. Such apparatus is shown and described in, for example, U.S. Pat. No. 3,554,531 to Heigl, et al. Briefly stated, this apparatus includes means for sequentially placing printed sheets into predetermined stacks at spaced intervals along a workpath defined by a continuously moving conveyor. The stacks or gathers are conveyed through caliper wheels adjacent the forward end of the conveyor for checking the thickness of each stack to confirm that a complete set of sheets is present. Each stack is then removed from the conveyor to a stationary stitcher assembly by means of a reciprocating shuttle mechanism. Following stitching, the stacks are moved to further processing stations along the workpath as required to complete a particular work requirement. Such additional processing stations may accommodate folding, trimming, sorting, collating, and the like.

Although the foregoing generally described binding apparatus has found commercial success, it does have certain practical drawbacks. For example, the apparatus includes a large number of moving parts which complicate manufacturing, while adding to subsequent adjustment and maintenance problems. Also, the general or overall versatility for the apparatus is reduced.

The present invention contemplates a new and improved automated binding apparatus which overcomes the above referenced problems and others. The invention provides such apparatus which has fewer moving parts, is more versatile, and is more economical to manufacture, adjust, and maintain.

SUMMARY OF THE INVENTION

In accordance with the present invention, a new stitcher assembly is provided for stitching together a plurality of workpieces as they are continuously conveyed longitudinally along a workpath. The stitcher assembly comprises a frame assembly, a workpiece supporting surface defining means, a frame assembly reciprocating means, a stitcher head actuating means, and a clincher actuating means. The frame assembly includes a stitcher head mounting means and a clincher mounting means which are adapted to mount at least one stitcher head and clincher in a cooperative relationship with each other. The surface defining means defines a workpiece supporting surface coextensive with the workpath intermediate the stitcher head mounting means and the clincher mounting means. The reciprocating means cyclically reciprocates the frame assembly longitudinally along the workpath in coordination with movement of the workpieces. The stitcher head actuating means is adapted to actuate at least one stitcher head mounted on the stitcher head mounting means. This actuating means is connected with the frame assembly and operatively connected with the reciprocating means for causing stitcher head actuation at a selected point in each reciprocation cycle. The clincher actuating means is adapted to actuate at least one clincher mounted on the clincher mounting means. This actuating means is also connected with the frame means and operatively connected with the reciprocating means for causing clincher actuation at substantially the same selected point in each reciprocation cycle as the stitcher.

According to a more detailed aspect of the invention, there is provided a binding apparatus which includes a feeding means for conveying stacks of sheets longitudinally along the workpath. The above described new stitcher assembly selectively stitches the conveyed stacks. Appropriate finishing means fold, turn, sort, and/or perform other finishing operations on the stitched stacks as may be required.

In accordance with another detailed aspect of the invention, there is provided a positive registration means for selectively fixing the relative position of a stack to be stitched and the frame assembly during a portion of each reciprocation cycle. The stitcher head and the clincher are actuated during this portion of the reciprocation cycle to insert a stitch in a preselected area of the stack.

In accordance with still another aspect of the invention, a method for binding stacks of sheets is advantageously provided. The stacks are continuously conveyed longitudinally along a workpath at regular spaced apart intervals. At least one stitcher head and clincher are cyclically reciprocated longitudinally of the workpath in predetermined coordination with conveying of the stacks. Each reciprocation cycle occurs in phase with the advancement of the stacks by the regular spaced interval. The stitcher head and clincher are actuated at the same point at each reciprocation cycle such that each stack is stitched in substantially the same place.

The present invention is advantageous in that a new stitcher assembly is provided which is relatively economical and simple to manufacture and assemble.

Another advantage resides in the provision of a stitcher assembly which is easier to adjust and maintain.

Yet another advantage is a new method of stitching which is cost effective, reliable, and adapted to a variety of job requirements.

Still further advantages of the present invention will become apparent to those of ordinary skill in the art upon reading and understanding the following detailed description of the preferred embodiment.

BRIEF DESCRIPTION OF THE DRAWINGS

The invention may take form in various parts and arrangements of parts and in various method steps and arrangement of steps. The drawings are only for purposes of illustrating a preferred and one alternative embodiment of the invention and not to be construed as limiting same.

DETAILED DESCRIPTION OF THE PREFERRED EMBODIMENT

Figure 1:
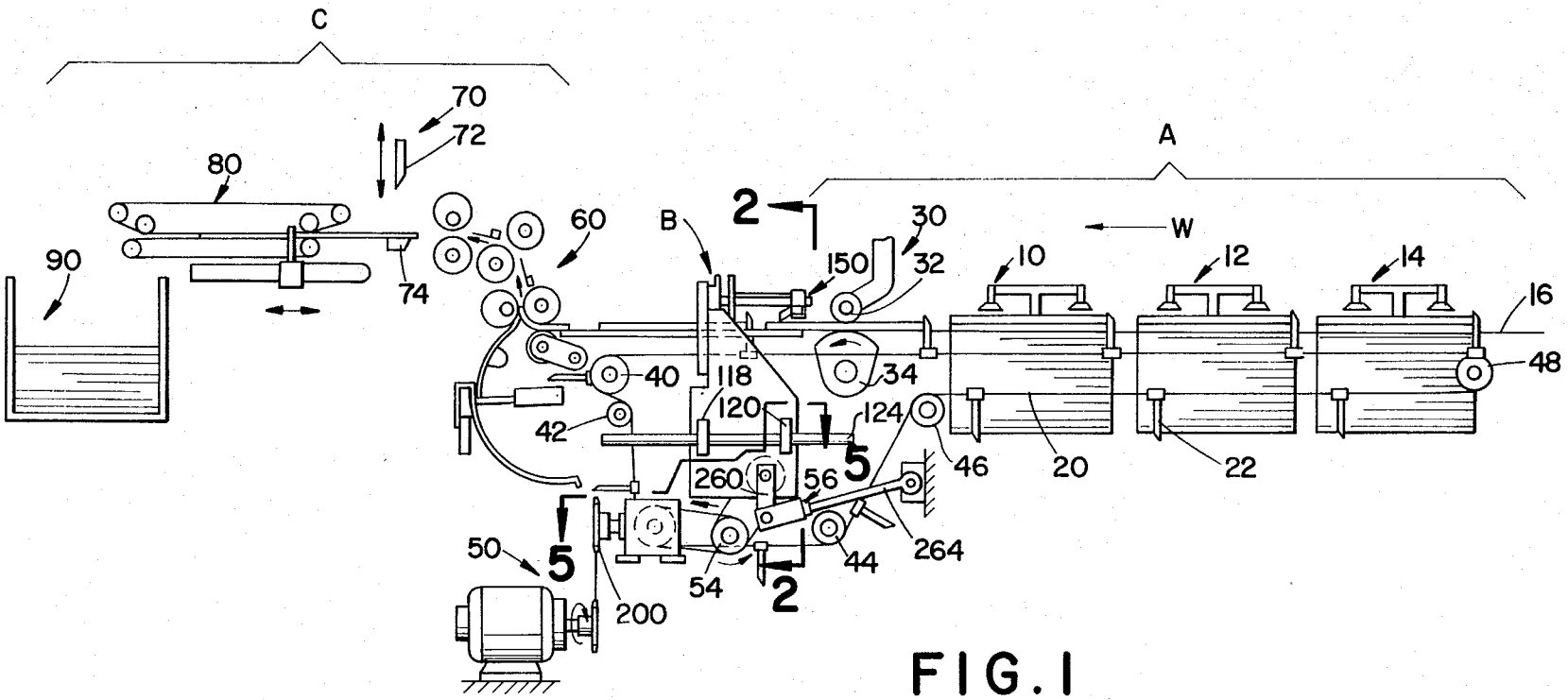
FIG. 1 is a diagrammatic illustration of an automated binding apparatus or machine formed in accordance with the present invention.

Referring now to the drawings wherein the showings are for purposes of illustrating the preferred and an alternate embodiment of the invention only and not for purposes of limiting same, FIG. 1 shows a feeding means A for continuously feeding stacks of sheets or other workpieces to be stitched longitudinally along a workpath in the direction of arrow w. A stitcher assembly B stitches the stacks as they are fed along the workpath to finishing means C which perform appropriate finishing operations on the bound stacks. Typically, the finished product comprises booklets, pamphlets, and the like.

The feeding means A includes a plurality of feed stations 10, 12, and 14, each of which includes known means for separating individual printed sheets from a source or pile and stacking them on other printed sheets moving along an inclined conveying surface 16. The conveying surface 16 is inclined at approximately 30° toward a lower rail (not shown in FIG. 1) against which the stacks are urged by gravity. Although only three feed stations are illustrated, it is to be appreciated that the actual number is commonly much larger. Specifically, the number of feed stations utilized matches the number of sheets to be bound.

A continuous chain conveyor 20 is provided and includes a plurality of regularly spaced dogs 22 extending through the inclined conveying surface 16. These dogs move sequentially past the feed stations at regular spaced intervals to engage and move or convey the sheets and resultant stacks of such sheets longitudinally along the workpath defined by the conveying surface 16. The chain dogs 22 move the stacks through an inspection station 30 which includes a pair of caliper wheels 32 and 34. These wheels determine whether or not the appropriate number of sheets are present in each stack.

The stitcher assembly B receives and registers the continuously conveyed stacks or gathers from the inspection station 30. The stitcher assembly reciprocates longitudinally along the workpath, i.e., in the direction of travel of the conveyor 20, and undergoes one reciprocation cycle each time the conveyor advances by the regular spaced interval between adjacent ones of the dogs 22. At a selected point in each reciprocation cycle, the stitching assembly stitches a registered, advancing stack. The particular portion or area of the stack which receives the stitch is selected by coordinating the stack registration, the reciprocation cycle, and the longitudinal position of the chain dogs 22.

Downstream from the stitcher assembly B, the chain conveyor turns on a sprocket 40. Thereafter, it moves along a return path including sprockets 42, 44, and 46, and then turns on another sprocket 48 to the rear of the feeder stations. Along the return run, the conveyor chain interacts with a drive means 50 and a reciprocating means 52 for cyclically reciprocating the stitcher assembly B longitudinally along the workpath in coordination with the longitudinal movement of the conveyor 20. The reciprocating means 52 includes a power take-off assembly 54, which comprises a dog leg belt drive arrangement in the preferred embodiment, and a reciprocating drive means 56 which drives the stitcher assembly B through the cyclic reciprocations with the power from the take-off means. The dog leg belt drive is connected with the drive means either directly or by way of the chain conveyor 20 and with the stitcher assembly to provide reciprocation driving power thereto.

The finishing means C includes a folding mechanism 60 which has two modes of operation and is disposed downstream from the stitcher assembly B. In one mode, each stitched stack is folded along the stitching for producing a book-like configuration and in the other mode, no folding occurs. A trimming assembly 70, including a face-trim knife 72 and a bed knife 74, is advantageously included for trimming the free edges of the stitched materials. A feeder assembly 80 is included for feeding the completed materials in a desired manner to a stacker 90 or other work collecting means. It will be appreciated that finishing stations 60, 70, 80, and 90 only comprise examples of ancillary binder apparatus to show the preferred use environment for the subject new stitcher assembly. Different or still other types of finishing stations may advantageously be incorporated without in any way departing from the overall intent or scope of the present invention.

Figure 2:
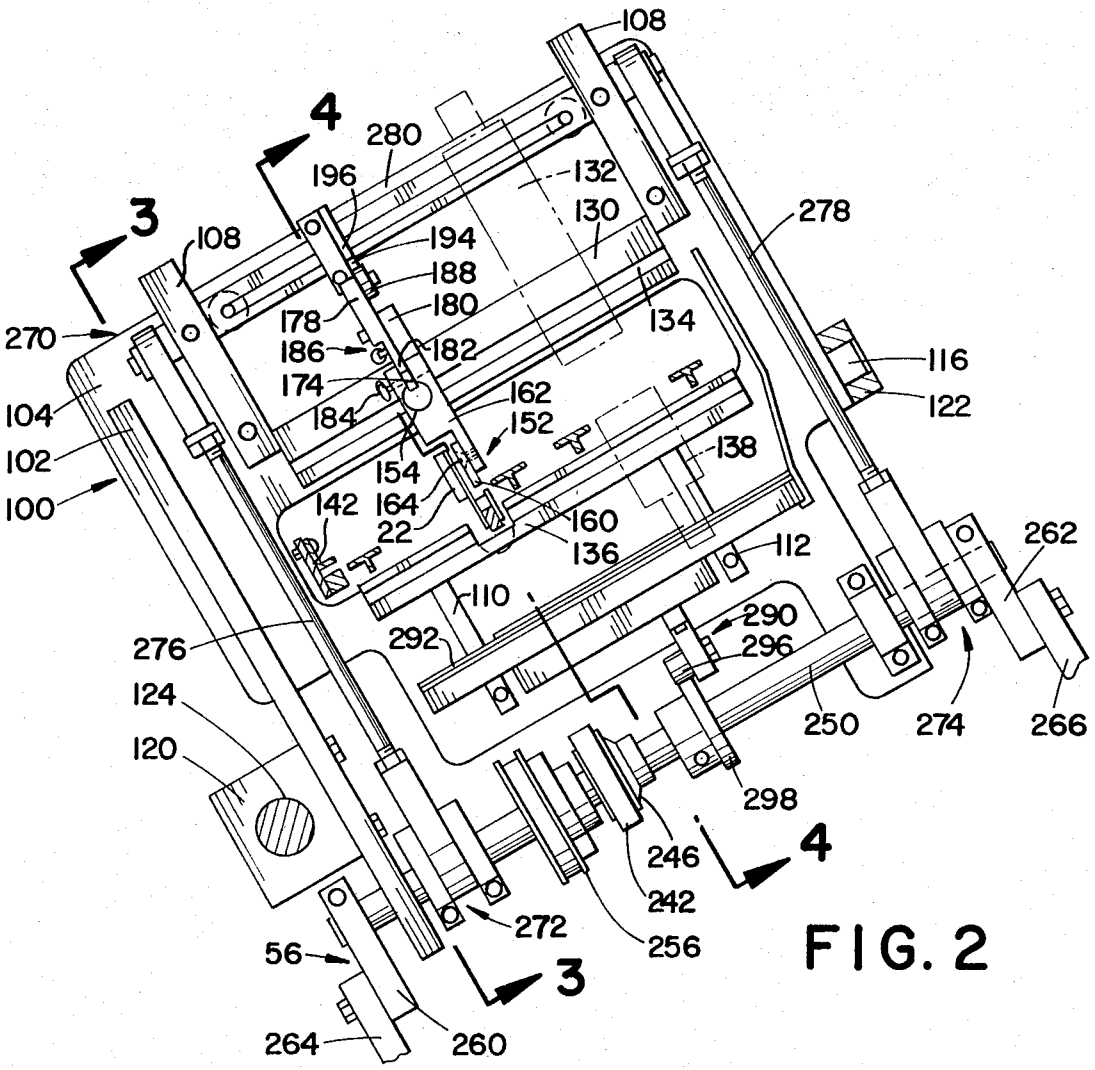
FIG. 2 is an elevational view of the stitcher assembly viewed in the direction of lines 2—2 of FIG. 1.
Figure 4:
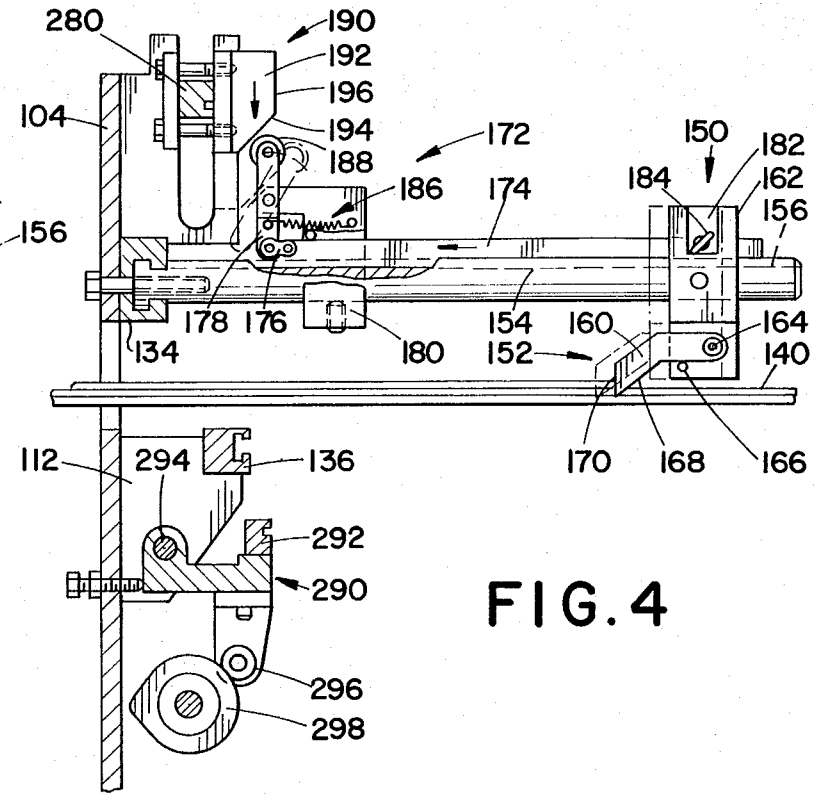
FIG. 4 is a cross-sectional view taken along lines 4—4 of FIG. 2 with the stitcher head and clincher similarly removed for ease of illustration.
Figure 3:
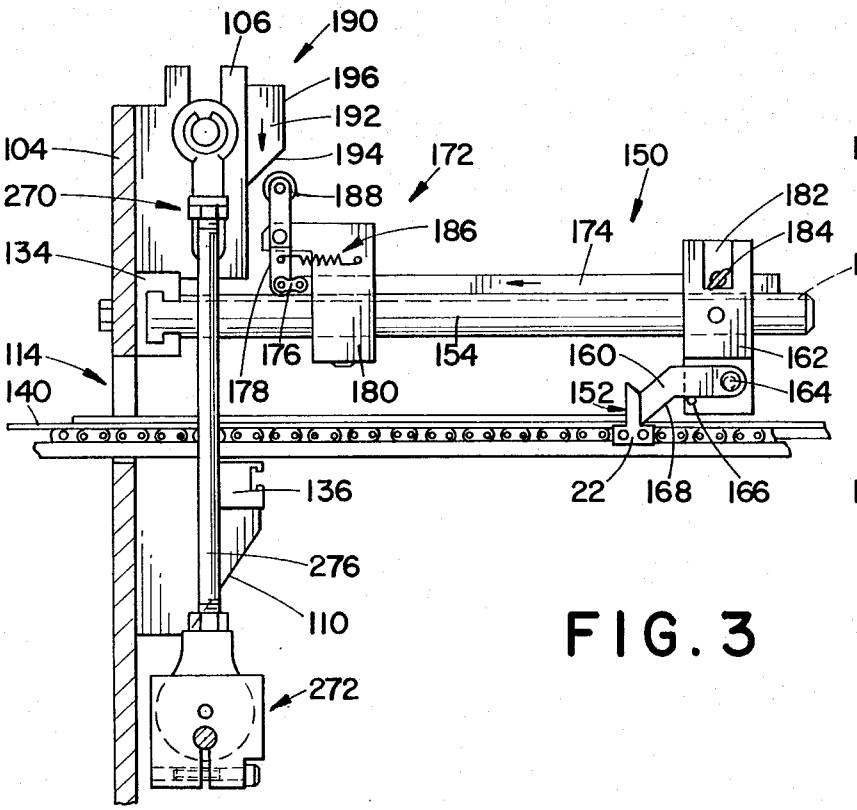
FIG. 3 is a cross-sectional view of the stitcher assembly drive taken along lines 3—3 of FIG. 2 with the stitcher head and clincher removed for ease of illustration.

With particular reference to FIG. 2 and secondary reference to FIGS. 3 and 4, the stitcher assembly B includes a frame assembly 100 having a side plate 102 and a back plate 104 fixedly secured in a normal relationship to each other. A pair of stitcher guides 106 and 108 having elongated guide slots therein are mounted to the back plate 104 such that the guide slots extend in a direction generally parallel to the plane of the back plate. A pair of clincher mounting plates 110 and 112 extend outwardly from the back plate in the same direction as the stitcher guides at areas located below a transversely extending plate opening 114. A longitudinal guide means including a follower 116 and bushings 118 and 120 constrain the frame assembly to reciprocate longitudinally, parallel to the workpath. The follower 116 extends outwardly from the back plate and is constrained to move along a longitudinal guide slot in a guide member 122. The guide member may be defined by a pair of bars or the like which are fixedly secured at their ends to, for example, the binding apparatus frame. The bushings 118 (FIG. 1) and 120 are mounted on the frame side plate 102 and slidably receive a longitudinal guide shaft 124.

A stitcher head mounting bar or means 130 adapted to mount one or more conventional stitcher heads 132 is affixed to the back plate 104 so as to extend transversely thereacross. The stitcher head mounting bar includes a T-slot 134 extending therealong so as to accommodate conventional stitcher head mounting as is known in the art. In the arrangement of the overall binding apparatus, the T-slot 134 facilitates adjustment of associated stitcher heads transversely of conveyor chain 20, i.e., transversely of the workpath. In the preferred environment of use for the subject new stitcher assembly, the stitcher heads 132 supply and insert metallic staple-like members into the stacks of printed materials being processed and bound.

A clincher mounting bar or means 136 is connected to the clincher mounting plates 110 and 112 so as to extend therebetween. The clincher mounting bar extends parallel to the stitcher head mounting bar 130 and is adapted to mount one or more conventional clinchers 138 in a cooperative relationship with the one or more stitcher heads 132. In the preferred environment, the clinchers fold over the free ends of the staple-like members.

A workpiece supporting surface defining means 140 extends longitudinally through the frame aperture 114 to support workpieces conveyed through the stitcher assembly. In the preferred embodiment shown, this surface defining means is comprised of a plurality of bars. Each of the bars is selectively removable for allowing a clincher to extend therebetween in close spaced relation to the remaining bars which define the workpiece supporting surface. The supporting surface defining means also includes a guide rail 142 at its downhill side against which the stacks are urged by gravity. The stacked sheets are maintained square and aligned by their sliding engagement along one edge with the guide rail and engagement on an adjacent edge with the associated chain dog 22.

With particular reference to FIGS. 3 and 4, a positive registration means 150 selectively fixes or registers the relative positions of each stack and the frame assembly during a registered portion of each reciprocation cycle. The registered portion of the cycle includes the stitching operation. More specifically, the registration means is operatively connected with the reciprocating means to be cyclically reciprocated in coordination with the frame assembly such that it advances each stack into a selected relationship with the stitcher head 132 and the clincher 138 during the registered portion of the cycle.

The registration means includes a dog means 152 for selectively engaging a trailing edge of each stack. The dog means is associated in a manner to be described with an elongated member 154 having an undercut slot or guideway 156 extending longitudinally along its upper side. Elongated member 154 is connected to the frame assembly. The elongated member, in the preferred embodiment, comprises a cylindrical rod which is slotted at one end to be received in the T-shaped stitcher head mounting bar slot 134. A machine screw or other suitable fastener passes through an aperture in the frame assembly into a threaded axial bore in the end of the rod for securely attaching the rod to the frame assembly.

The dog means 152 includes a dog member 160 which is pivotally mounted on a dog supporting structure 162 by a pivot member 164. The dog member 160 is configured and mounted so that it is biased by gravity toward a position in which it extends slightly below the workpiece supporting surface. A limit pin 166 limits the downward movement of the dog member and the dog supporting structure limits its upward movement. As the frame assembly with the dog member moves upstream during the reciprocation cycle, an upstream dog camming surface 168 cams the dog member over a stack being advanced by the chain conveyor 20. After the frame assembly reverses directions and moves downstream, a downstream edge 170 engages the stack to advance it ahead of its associated chain dog. The dog is configured such that when it is disposed in its lowermost position, downstream edge 170 extends substantially normal to the workpiece supporting surface for maintaining a precise stacked relationship between individual sheets which comprise a stack. The dog member determines the relative positions of the stack and the frame assembly until the frame assembly slows sufficiently or reverses direction allowing the associated chain dog to recommence conveying the stack.

With particular reference to FIGS. 3 and 4, an advancement means 172 advances each stack toward the frame a short, preselected distance just prior to the insertion of a stitch. This assures that the dog member 160 rather than the chain dog 22 determines the relative positions of the stack and stitcher head during insertion of the stitch. The advancement means includes a brass member 174 slidably received in the elongated member slot 156. A link 176 pivotally connects one end of the brass member with a lever 178. The lever is pivotally supported on a fulcrum member 180 which is fixedly mounted to the elongated member 154.

The dog mounting structure 162 is slidably received on the elongated member and adjustably clamped to the brass member 174. To inhibit binding, the dog mounting structure has a transverse slot which slidably receives a mounting block 182. The mounting block has a keyway which receives the brass member and a threaded bore which intersets the keyway for receiving a set screw 184. The set screw clamps the mounting block to the brass member to cause the dog means to undergo longitudinal movement therewith. The adjustably clamped relationship of the dog mounting structure allows the dog means to be selectively positioned a desired distance from the stitching head when and as may be required. This desired distance will correspond to the distance between the trailing edge of the stack of sheets and the area at which the stitch is to be inserted. A biasing means 186 continuously urges the lever 178 to a normal or non-advanced position. Because of their interconnected relationship with the lever, the brass means 174 and the dog means will similarly be continuously urged to a normal or non-advanced position. A cam follower means 188, such as a roller or the like, is conveniently mounted to the link 178 adjacent the outer terminal end thereof.

An advancement actuator means 190 causes the advancement means to advance the dog means 152 the preselected distance along the elongated member 154. More specific to the preferred embodiment, the advancement actuator means 190 includes a cam element 192 which defines a cam surface 194 for engaging the cam follower 188. The cam element 192 is mounted on a stitcher actuating bar 280 such that the cam surface engages the cam follower at a preselected point in the reciprocation cycle in close coordination with the insertion of a stitch. The cam surface 194 terminates at a vertical edge surface 196 to fix the distance which the cam follower and, hence, the dog means advance. In this manner, the advancement distance of the dog means is independent of the vertical displacement of the cam surface. By way of example, it is expected that cam surface 194 will be designed to effect a linear movement of the dog means approximately equal to $\frac{1}{4}$ inch or so.

Of course, this distance may be altered as deemed necessary or appropriate without departing from the overall intent of the invention.

In operation, the reciprocation of the frame assembly moves the dog means upstream behind the trailing edge of each stack, then downstream toward engagement with the trailing edge. The advancement means 172 is designed so that the dog means 152 will engage the stack trailing edge prior to the time the stitch is inserted. Just prior to insertion, and as the stitcher is mechanically activated, the advancement actuator means 190 is also activated for causing advancement means 172 to move the dog means the preselected distance toward the frame to position the selected stitch receiving area under the stitcher head. This assures that the dog means 152 rather than the chain dog controls the position of the stack trailing edge and hence, the position of the stitch receiving area. Details of this operation will become more readily apparent hereinafter.

Optionally, a plurality of like registration means may be mounted at intervals along the stitcher head mounting bar 130. As yet another alternate embodiment, the registration means may be connected with a portion of the frame below the workpiece supporting surface, such as the clincher mounting bar 136. If the dog member 160 extends from below the work receiving surface to engage the stacks, a mechanical biasing means is provided to bias the downstream dog edge 170 partially above the workpiece supporting structure.

Figure 5:
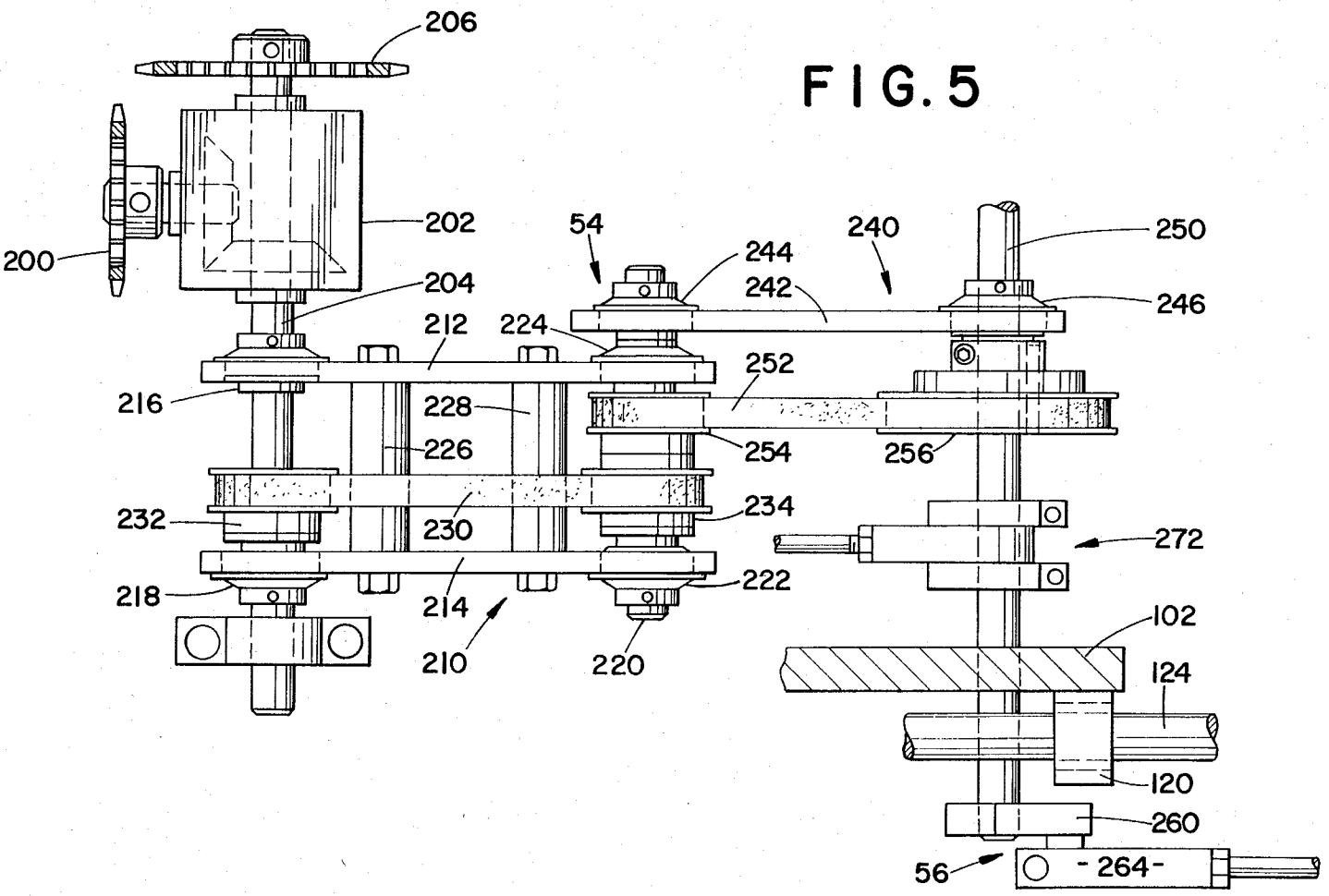
FIG. 5 is a cross-sectional view taken along lines 5—5 of FIG. 1.

With particular reference to FIG. 5 and with continuing reference to FIG. 1, the reciprocating means 52 causes the frame assembly to undergo a complete longitudinal travel and return cycle each time the conveyor 20 moves a distance equal to its interdog spacing. The power take-off 54 of the reciprocating means includes a sprocket 200 which is connected with the drive means 50 to be driven thereby. The sprocket 200 is connected by a transmission 202 with a transverse, frame mounted drive shaft 204. A conveyor chain sprocket 206 is mounted on the frame drive shaft for propelling the conveyor chain 20.

A first leg assembly 210 is pivotally mounted on the frame drive shaft. The first leg assembly 210 includes a pair of side brackets 212 and 214 which are pivotally mounted on the frame drive shaft at one end by bearings 216 and 218. The first leg assembly side brackets are pivotally mounted at their other ends with a free moving shaft 220 by means of bearings 222 and 224. Spacers 226 and 228 connect the first leg assembly side brackets to fix the free moving shaft 220 into a parallel relationship with the frame drive shaft 204. A first flexible drive means, such as a toothed timing belt 230, extends between a first pulley 232 and a second pulley 234 which are connected with the frame drive shaft and the free moving drive shaft 220, respectively, to transmit motive power to the free moving drive shaft.

A second leg assembly 240 includes a side bracket 242 which is pivotally mounted at one end by a bearing 244 with the free floating drive shaft 220 and is pivotally mounted at its other end by a bearing 246 with a stitcher assembly transverse drive shaft 250. A second, flexible drive means, such as a second toothed timing belt 252, extends between a third pulley 254 which is connected to the free moving shaft 220 and a fourth pulley 256 which is releasably connected to stitcher assembly transverse drive shaft 250. The releasable connection allows the relationship between the frame assembly reciprocation cycle and the chain dogs to be adjusted which, in turn, facilitates longitudinal adjustment of the stitch receiving area in the stacks.

With reference to FIGS. 1, 2, and 5, the reciprocating drive means 56 converts the rotary motion of the stitcher assembly drive shaft 250 into a reciprocating drive force for driving the frame assembly through the cyclic reciprocations. The reciprocating drive means includes a pair of lever arms 260 and 262 attached to either end of the stitcher assembly drive shaft 250 for rotation therewith. A pair of connecting links 264 and 266 are mounted between the free ends of the lever arms and a stationary structure, e.g., the conveyor frame or the like. In this manner, rotation of the stitcher assembly transverse drive shaft and the lever arms drive the frame assembly cyclically back and forth along the guide means with simple harmonic motion.

With particular reference to FIG. 3 and continuing with reference to FIG. 2, a stitcher head actuating means 270 is adapted to actuate the one or more stitcher heads which are mounted on the stitcher head mounting bar 130. The stitcher head actuating means includes a pair of eccentric connecting means 272 and 274, such as a pair of cranks or the like, which are mounted on the transverse drive shaft 250 to move stitcher head actuating shafts 276 and 278 cyclically through a fixed throw as the transverse shaft rotates. A stitcher head actuating bar 280, which rides in the guide slots of stitcher guides 106 and 108, is connected across the actuating shafts. The eccentric connecting means are dimensioned such that the stitcher head actuating bar 280 moves in the guide slots over a throw of approximately two inches. In this manner, the stitcher head actuating means actuates the one or more stitcher heads 132 in a conventional manner in coordination with the conveyer chain 20. The stitches are driven into substantially the same pre-selected location in each stack of sheets being stitched as fixed by the positive registration means 150.

With particular reference to FIG. 4 and continuing with reference to FIG. 2, a clincher actuating means 290 is adapted to actuate clinchers mounted on the clincher mounting bar. The clincher actuating means includes a clincher actuator bar 292 which is mounted by a pivot 294 on the clincher mounting plates 110 and 112. A clincher cam follower 296 depends from the clincher actuating bar 292 to engage a clincher eccentric means or cam 298 mounted on the stitcher assembly transverse drive shaft 250 for rotation therewith. The clincher cam has a single lobe which is positioned relative to the angular position of the transverse drive shaft 250 and the stitcher eccentric mountings 272 and 274 such that it actuates the clinchers to clinch or fold the ends of the stitches immediately upon their insertion by the stitcher heads through the stack of sheets.

In this manner, the stacks of sheets to be stitched move continuously along the conveyor 20. When the stitcher assembly B is disposed at its maximum upstream position along the workpath w, the dog member downstream edge 170 is spaced slightly upstream from the trailing edge of the stack of sheets to be stitched and the downstream edge of the associated chain dog 22. Typically, this spacing will only be on the order of magnitude of $\frac{1}{8}$ inch or so. Thereafter, as the stitcher assembly begins to accelerate longitudinally along the workpath, advancement actuator means 190 is activated to advance the dog means 152 in a manner previously described. With this advancement, downstream edge 170 of the dog member positively advances the stack ahead of the associated chain dog and positions the stack in a preselected registration with the stitcher heads and clinchers. As both the stitcher assembly and stacks of sheets are then moving together in the preselected registration, the stitcher heads and clinchers are in alignment with the pre-selected area of the stacked sheets in which the stitch is to be inserted. The stitcher head and clincher insert and clinch the stitch in the manner described as the frame continues its longitudinal movement along the workpath. After the stitch is completed, the frame assembly and the registration means slow and eventually reverse direction to undertake another cycle. As the frame assembly slows, the associated chain dog 22 passes the registration dog member 160 and continues advancement of the stack. In this manner, a precise matching between the speed of the stitcher assembly and the conveyor is not required.

To change the stitch receiving area longitudinally of the workpath, the registration dog means 152 is shifted along the brass member 174. If necessary, the fourth pulley 256 is released from the stitcher assembly transverse drive shaft 250 and the relationship between the stitcher assembly and the chain dogs is adjusted. Further, the stitcher head and clincher can be slid transversely, along their respective mounting bars, to position them at different transverse coordinates. In this manner, a wide variety of stitch receiving area specifications are accommodated.

Figure 6:
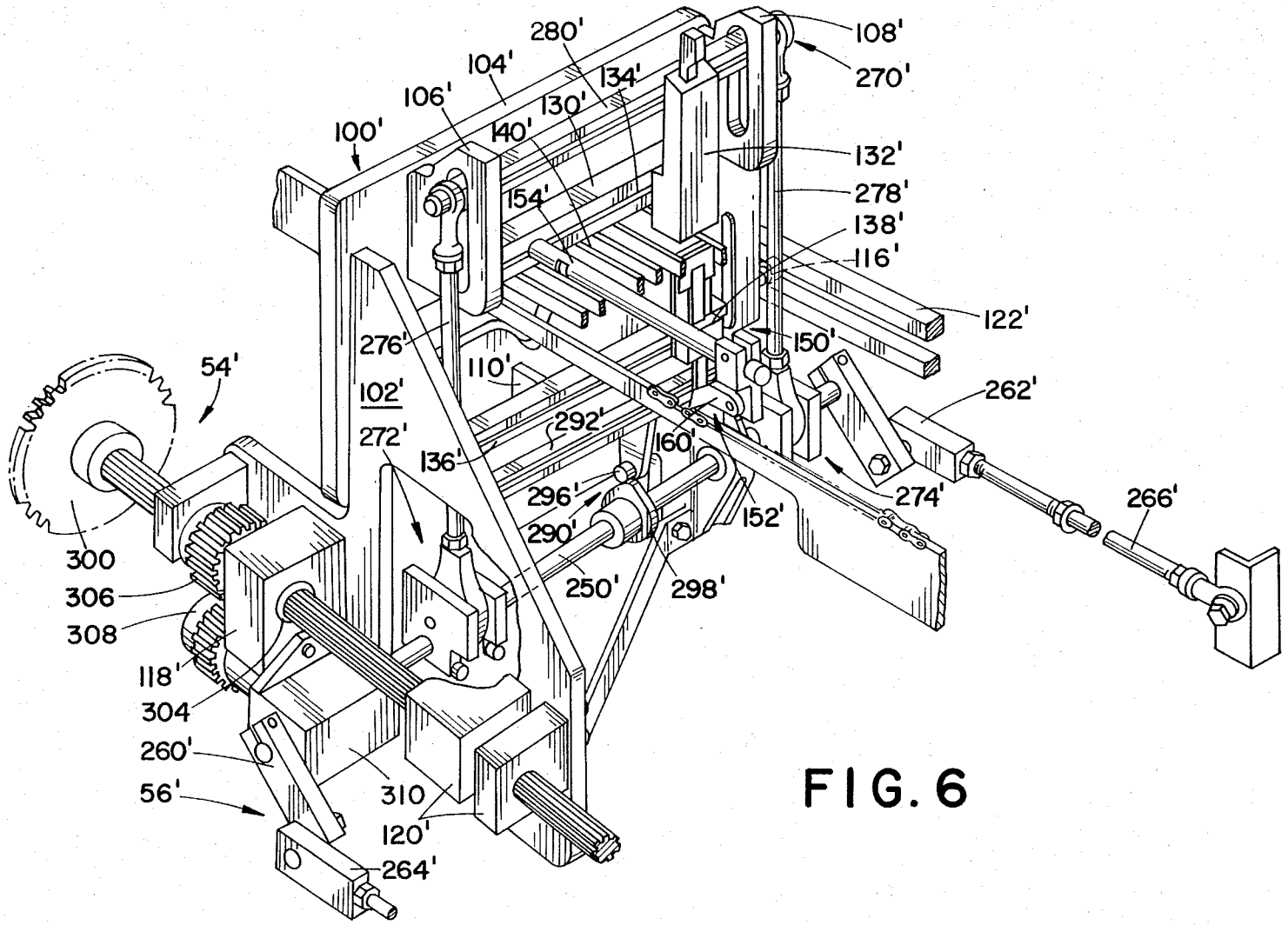
FIG. 6 is a perspective view of an alternate embodiment of the stitcher assembly constructed in accordance with the present invention.

FIG. 6 illustrates an alternate embodiment of a stitcher assembly constructed in accordance with the present invention. In the embodiment of FIG. 6, like elements with the embodiment of FIGS. 1–5 are denoted with the same reference numeral but followed by a prime (′) suffix.

In FIG. 6, the stitcher assembly includes a frame assembly 100′ including a side plate 102′, a back plate 104′, a pair of stitcher guides 106′ and 108′, and a pair of clincher mounting plates 110′ and 112′. A longitudinal guide means includes a follower 116′ extending outwardly from the back plate to engage a guide slot 122′ and a pair of bushings 118′ and 120′ extending outwardly from the side plate to engage a guideshaft 124′. A stitcher mounting bar or means 130′ which is affixed to the back plate 104′ is adapted to mount one or more conventional stitcher heads 132′ in a T-shaped mounting slot 134′. A clincher mounting bar or means 136′ is mounted on the clincher mounting plates 110′ and 112′ parallel to the stitcher head mounting bar. The clincher mounting bar is adapted to mount one or more conventional clinchers 138′ in a cooperative relationship with the one or more stitcher heads. A plurality of bars define a workpiece supporting surface 140′ extending longitudinally of back plate aperture 114′.

A positive registration means 150′ selectively fixes the relative position of each stack and the frame assembly. The registration means includes an elongated member 154′ to which a dog means 152′ is adjustably mounted. In the embodiment of FIG. 6, the dog means relies solely on the reciprocation of the frame assembly to move the dog means behind the trailing edge of each stack and to advance each stach ahead of an associated chain dog. In this alternative embodiment, the downstream end of elongated member 154′ may be conveniently mounted in T-shaped stitcher mounting slot 134′.

A power take-off assembly 54′ of a reciprocating means 52′ includes a sprocket 300 which is connected to the drive means in coordination with the chain conveyor 20 to be driven therewith. The sprocket 300 rotates the longitudinal shaft 124′ which, in the embodiment of FIG. 6, is splined. The bushing 118′ includes a splined sleeve 304 which meshes with the splines on the shaft 124′. The splined sleeve 304 is connected by a pair of gears 306 and 308 and a transmission means 310 with a stitcher assembly transverse drive shaft 250′. In this embodiment, the splined shaft 124′ and the transverse drive shaft 250′ are connected with a 1:1 gear ratio such that the splined shaft rotates 360° with each cyclic reciprocation of the frame assembly. A reciprocating drive means 56′ includes a pair of lever arms 260′ and 262′ which are connected to opposite ends of the transverse drive shaft 250′. A pair of connecting links 264′ and 266′ are mounted between the free ends of the lever arms and some fixed structure, e.g., the conveyor frame. Thus, the transverse drive shaft is rotated by the power take-off, and the reciprocating drive means converts the rotational movement into cyclic reciprocations of the stitcher assembly B.

A stitcher head actuating means 270′ includes a pair of eccentric connecting means 272′ and 274′ such as a pair of cranks mounted on the stitcher assembly transverse drive shaft 250′. Stitcher head actuating shafts 276′ and 278′ are connected between the eccentric connecting means and a stitcher head actuating bar 280′ to move it through a fixed throw in coordination with rotation of the transverse drive shaft. A clincher actuating means 290′ includes a clincher actuating bar 292′ which is pivotally mounted on the clincher mounting plates 110′ and 112′. A clincher cam follower 296′ depends from the clincher actuating bar 292′ to engage a clincher eccentric means or cam 298′ which is mounted on the transverse drive shaft 250′ for rotation therewith. The clincher cam has a single lobe which is positioned in coordination with the angular position of the eccentric mounting means 272′ and 274′ on the stitcher assembly transverse drive shaft. The clincher cam and the stitcher eccentric means are coordinated to actuate the clinchers to clinch or fold the ends of the stitches immediately upon their insertion by the stitcher heads through the stack of sheets.

Although the invention is described in terms of the preferred and alternate embodiments, it is to be appreciated that other fastener inserting structures can be mounted and actuated by the stitcher head and clincher mounting means and by the associated actuating means. For example, the stitcher head mounting means can mount a rivet inserting head and the stitcher head actuating means can actuate it. As another example, the stitcher head mounting and actuating means can mount and press a heated metal element against conveyed plastic workpieces to heat-weld them. Similarly, the clincher mounting and actuating means can mount and actuate a rivet crimping means, a platen, or the like.

The invention has been described with reference to the preferred and alternate embodiments. Obviously, further modifications and alterations will occur to others upon reading and understanding the preceding detailed description of the preferred embodiment. It is intended that the invention be construed as including all such alterations and modifications insofar as they come within the scope of the appended claims or the equivalents thereof.

Having thus described the invention, it is now claimed:

1. A method of binding stacks of sheets, the method comprising the steps of:

continuously conveying the stacks longitudinally at regular intervals along a workpath;

cyclically reciprocating at least one stitcher head and clincher longitudinally of the workpath in coordination with the conveying of the stacks, each reciprocation cycle occurring in the same time as the stacks advance by said regular interval;

during a portion of each reciprocation cycle, carrying each stack in a preselected relationship with the stitcher head and clincher such that the regular interval between the carried stack and the other stacks is temporarily disrupted; and, actuating the stitcher head and clincher during said reciprocation cycle portion at the same point in each reciprocation cycle, such that the stacks are stitched at substantially the same areas thereof.

2. The method as set forth in claim 1 further including the step of returning the carried stitched stack to the regular interval relationship with the other stacks subsequent to the step of actuating.

3. A stitcher assembly for stitching workpieces which are being conveyed longitudinally along a workpath, said assembly comprising:

a frame assembly having a longitudinal axis extending therethrough and including a stitcher head mounting means and a clincher mounting means which are adapted to mount at least one stitcher head and clincher in a cooperative relationship to the frame assembly;

surface defining means for defining a workpiece supporting surface extending longitudinally through the frame assembly generally intermediate the stitcher head mounting means and the clincher mounting means;

reciprocating means for cyclically reciprocating the frame assembly generally along the workpath in coordination with movement of the conveyed workpiece along the workpath;

a stitcher head actuating means which is adapted to actuate at least one stitcher head mounted on the stitcher head mounting means, the stitcher head actuating means being operatively connected with the frame assembly and operatively connected with the reciprocating means to cause stitcher head actuation at a selected point in each reciprocation cycle;

a clincher actuating means which is adapted to actuate at least one clincher mounted on the clincher mounting means, the clincher actuating means being operatively connected with the frame assembly and operatively connected with the reciprocating means to actuate the clinchers at substantially said selected point in each reciprocation cycle; and, registration means for cyclically fixing the relative positions of the frame assembly and each workpiece, the registration means being operatively connected with the reciprocating means to be cyclically reciprocated in coordination with the frame assembly.

4. The stitcher assembly as set forth in claim 3 wherein the surface defining means includes a plurality of support bars, each of the support bars being selectively removable from association with the stitcher assembly to accomodate positioning of a clincher.

5. The stitcher assembly as set forth in claim 3 wherein the reciprocating means includes a reciprocating drive means operatively connected to a power take-off assembly for driving the frame assembly through the cyclic reciprocations.

6. The stitcher assembly as set forth in claim 5 wherein the reciprocating drive means drives the frame assembly with simple harmonic motion.

7. The stitcher assembly as set forth in claim 5 wherein the reciprocating drive means includes: a lever arm means mounted at one end on a transverse drive shaft having an axis transverse to the longitudinal axis for rotation around the transverse axis, the transverse drive shaft being operatively connected with the power take-off assembly to be driven thereby; and, a connecting link connected with the other end of the lever arm means, such that rotation of the lever arm drives the frame assembly cyclically along the longitudinal axis.

8. The stitcher assembly as set forth in claim 7 wherein the transverse drive shaft is rotatably mounted on the frame assembly and the connecting link is connected adjacent one end with a stationary structure and wherein the stitcher head actuating means and the clincher actuating means are operatively connected with the transverse drive shaft to synchronize stitcher head and clincher actuation with rotation of the transverse drive shaft.

9. The stitcher assembly as set forth in claim 5 further including a transverse drive shaft rotatably mounted on the frame assembly transverse to the longitudinal shaft, the transverse drive shaft being operatively connected with the reciprocating drive means to be rotated in coordination with the reciprocating movement of the frame assembly.

10. The stitcher assembly as set forth in claim 9 further including a first eccentric connecting means for connecting the transverse drive shaft and the stitcher head actuating means to cause the stitcher head actuation at a selected rotational position of the transverse drive shaft.

11. The stitcher assembly as set forth in claim 10 further including a second eccentric means for connecting the transverse drive shaft and the clincher actuating means to cause clincher actuation at a selected rotational position of the transverse drive shaft.

12. The stitcher assembly as set forth in claim 9 wherein the power take-off means includes a dog leg arrangement operatively connected between the transverse drive shaft and a frame mounted drive shaft for transferring motive power from the frame drive shaft to the transverse drive shaft.

13. The stitcher assembly as set forth in claim 12 wherein the dog leg assembly includes a first leg pivotally connected between the frame drive shaft and a free moving shaft and a second leg assembly pivotally connected between the free moving shaft and the transverse drive shaft, the first leg assembly including a flexible drive means connecting the frame drive shaft and free moving shaft such that the free moving shaft is caused to rotate with the frame drive shaft and wherein the second leg assembly includes a second flexible drive means connected between the free moving shaft and the transverse drive shaft such that the transverse drive shaft is rotated with the free moving shaft, whereby power is conveyed from the frame drive shaft to the transverse drive shaft.

14. The stitcher assembly as set forth in claim 13 wherein the first and second flexible drive means are toothed belts.

15. The stitcher assembly as set forth in claim 5 wherein the power take-off assembly includes a splined shaft which is rotated in coordination with the movement of the conveyed workpieces and a splined bushing slidably mounted on the longitudinal shaft to slide longitudinally therealong while being rotated thereby, the splined bushing being operatively connected with the transverse drive shaft.

16. The stitcher assembly as set forth in claim 3 wherein the registration means includes a dog means for engaging a trailing edge of the workpiece for moving the workpiece in coordination with the reciprocation of the frame assembly.

17. The stitcher assembly as set forth in claim 16 wherein the registration means includes means for mounting the dog means with the frame assembly at a selectively adjustable distance from the stitcher head mounting means.

18. The stitcher assembly as set forth in claim 17 wherein the dog means includes at least one pivotally supported mechanical dog member.

19. The stitcher assembly as set forth in claim 18 wherein the mechanical dog member is pivotally mounted above the surface defining means such that the mechanical dog member is biased by gravity toward a lowermost position for engagement with the workpiece trailing edge.

20. The stitcher assembly as set forth in claim 16 wherein the registration means includes an elongated member to which the dog means is operatively connected and an affixing means for connecting the elongated member with the frame assembly.

21. The stitcher assembly as set forth in claim 20 further including means for mounting the dog means at a selectively adjustable distance along the elongated member.

22. The stitcher assembly as set forth in claim 16 wherein the registration means further includes advancing means for advancing the dog means and associated workpeice toward the frame assembly in coordination with the reciprocation cycle.

23. The stitcher assembly as set forth in claim 22 wherein the registration means further includes an elongated member on which the dog means is slidably mounted and wherein the advancing means slides the dog means along the elongated member at a selected point in each reciprocation cycle.

24. The stitcher assembly as set forth in claim 23 wherein the registration means includes actuating means operatively connected with the stitcher head actuating means for causing the advancing means to slide the dog means toward the frame assembly in coordination with stitcher head actuation.

25. The stitcher assembly as set forth in claim 24 wherein the actuating means includes a cam surface mounted for movement with the stitcher head actuating means and the advancing means includes a cam follower means positioned to be engaged and moved by the cam surface, the cam follower means being operatively connected with the dog means such that the dog means is moved slidingly along the elongated member therewith.

26. A binding apparatus comprising:

(a) a feeding means for continuously conveying stacks of sheets along a workpath;

(b) a stitcher assembly for stitching the stacks, the stitcher assembly including:

(i) a frame assembly including a stitcher head mounting means and a clincher mounting means to which at least one stitcher head and clincher are mounted in a cooperative relationship;

(ii) surface defining means for defining a stack supporting surface extending through the frame assembly longitudinally along said workpath between the stitcher head and the clincher;

(iii) reciprocating means for cyclically reciprocating the frame assembly longitudinally along said workpath in coordination with the movement of the conveyed stacks along said workpath;

(iv) a stitcher head actuating means for actuating the stitcher head, the stitcher head actuating means being operatively connected with the frame assembly and operatively connected with the reciprocating means to cause stitcher head actuation at a selected point in each reciprocation cycle;

(v) a clincher actuating means for actuating the clincher, the clincher actuating means being operatively connected with the frame assembly and operatively connected with the reciprocating means to actuate the clinchers at substantially said selected point in each reciprocation cycle;

(vi) a registration means which includes a dog means for selectively engaging a trailing edge of each stack, the dog means being disposed a selectively adjustable distance upstream along the workpath from the stitcher head, and being operatively connected with the reciprocating means to be cyclically reciprocated in coordination with the frame assembly such that each stack is positioned in a selected registration with the stitcher head and clincher during at least a portion of each frame assembly reciprocation cycle; and, (c) finishing means for finishing the stitched stacks.

27. The binding apparatus as set forth in claim 26 wherein the feeding means includes a conveyor which has projecting dogs for engaging the stacks, the conveyor extending through the stitcher assembly coextensive with the workpath to convey the stacks therealong.

28. The binding apparatus as set forth in claim 27 further including means for coordinating the movement of the conveyor and the stitcher assembly reciprocating means.

29. The binding apparatus as set forth in claim 26 wherein the reciprocating means includes a reciprocating drive means operatively connected with a power take-off assembly for driving the frame assembly through the cyclic reciprocations.

30. The binding apparatus as set forth in claim 29 further including a stitcher assembly transverse drive shaft rotatably mounted on the frame assembly and operatively connected with the power take-off assembly to be rotated thereby in coordination with reciprocation of the frame assembly and wherein the stitcher head actuating means and the clincher actuating means are operatively connected with the stitcher assembly transverse drive shaft to synchronize stitcher head and clincher actuation with rotation of the stitcher assembly transverse drive shaft.

31. The binding apparatus as set forth in claim 30 wherein the reciprocating drive means includes: a lever arm means mounted at one end on the stitcher assembly transverse drive shaft for rotation around the transverse axis, and a connecting link mounted between the other end of the lever arm means and a stationary structure, such that rotation of the lever arm drives the frame assembly through the cyclic reciprocations.

32. The binding apparatus as set forth in claim 30 wherein the power take-off assembly includes a first leg assembly pivotally connected at one end with a frame mounted drive shaft and pivotally connected at its other end with a free moving shaft, and a first drive means connecting the frame mounted drive shaft and the free moving shaft such that the free moving shaft is rotated with the frame mounted drive shaft; and a second leg assembly which is pivotally mounted at one end with the free moving shaft and pivotally mounted at its other end with the stitcher assembly transverse drive shaft and a second drive means connected between the free moving shaft and the stitcher assembly transverse drive shaft such that the stitcher assembly transverse drive shaft is rotated with the free moving shaft.

33. The binding apparatus as set forth in claim 29 wherein the power take-off means rotates a splined, longitudinal shaft disposed parallel to the workpath in coordination with the advancement of the conveyor and a splined bushing slidably mounted on the splined shaft for transmitting rotational motion from the splined shaft to the stitcher assembly transverse drive shaft.

34. The binding apparatus as set forth in clain 25 wherein the registration means further includes advancing means for advancing the dog means toward the stitcher head and clincher at a selected point in each reciprocation cycle such that the dog means is assured of engaging the stack trailing edge before stitcher head actuation.

35. The binding apparatus as set forth in claim 25 wherein the registration means further includes an elongated member for operatively connecting the dog means to the frame assembly.

36. The binding apparatus as set forth in claim 35 wherein the registration means further includes registration adjustment means for mounting the dog means a selectively adjustable distance upstream from the stitcher head.

37. The binding apparatus as set forth in claim 35 wherein the dog means includes at least one dog member which is mounted to be pivotable out of the workpath by each stack as it is conveyed toward the frame assembly and is thereafter biased to pivot behind each stack to advance each stack in coordination with the reciprocation of the frame assembly.

38. The binding apparatus as set forth in claim 37 wherein the dog member is disposed above the workpath and is gravity biased.

39. A stitcher assembly for stitching workpieces, the stitcher assembly including:

a frame assembly;

a stitcher head mounting means and a clincher mounting means to which at least one stitcher head and clincher are mounted in a cooperative relationship, the stitcher head and clincher mounting means being operatively connected with the frame assembly;

reciprocating means for cyclically moving the frame assembly through reciprocating cycles;

a dog means for engaging an edge of each workpiece to register the position of the workpiece relative to the stitcher head and clincher during a portion of each reciprocation cycle;

means for connecting the dog means with the frame assembly such that the dog means moves through the reciprocation cycles therewith; and, a stitcher head actuating means for actuating the stitcher head during said reciprocating cycle portion such that the relative position fixed by the dog means determines an area of each workpiece which receives a stitch.

40. The assembly as set forth in claim 39 further including an elongated member secured adjacent one end thereof with the frame assembly, the dog means being mounted on the elongated member for limited sliding movement therealong.

41. The assembly as set forth in claim 40 further including advancing means for sliding the dog means a preselected distance along the elongated member as a selected point in each reciprocation cycle.

* * * * *